US007709753B1

(12) United States Patent
Russo

(10) Patent No.: US 7,709,753 B1
(45) Date of Patent: May 4, 2010

(54) ELECTRICAL WIRING BLOCK SYSTEM

(76) Inventor: Michael H. Russo, 9054 Jill Dr., Conifer, CO (US) 80433-9709

( * ) Notice: Subject to any disclaimer, the term of this patent is extended or adjusted under 35 U.S.C. 154(b) by 369 days.

(21) Appl. No.: 11/936,647

(22) Filed: Nov. 7, 2007

(51) Int. Cl.
*H01R 13/46* (2006.01)

(52) U.S. Cl. ..... 174/520; 174/53; 174/135; 439/701; 439/949

(58) Field of Classification Search ..... 174/520, 174/53, 135, 50; 439/701, 949, 212, 76.2
See application file for complete search history.

(56) References Cited

U.S. PATENT DOCUMENTS

| | | | | |
|---|---|---|---|---|
| 4,165,443 | A | 8/1979 | Figart et al. | |
| 5,399,806 | A | 3/1995 | Olson | |
| D402,186 | S | 12/1998 | Pearse | |
| 6,022,247 | A * | 2/2000 | Akiyama et al. | 439/701 |
| 6,201,187 | B1 | 3/2001 | Burbine | |
| 6,361,333 | B1 | 3/2002 | Cash, Jr. | |
| 6,617,511 | B2 | 9/2003 | Schultz et al. | |
| 6,945,815 | B1 | 9/2005 | Mullally | |
| 7,108,566 | B2 * | 9/2006 | Kressmann et al. | 439/701 |
| 7,175,488 | B2 * | 2/2007 | Pavlovic et al. | 439/858 |
| 7,422,490 | B2 * | 9/2008 | Droesbeke et al. | 439/701 |
| 7,554,034 | B2 * | 6/2009 | Smith | 174/53 |
| 7,633,017 | B2 * | 12/2009 | Young et al. | 174/520 |

* cited by examiner

*Primary Examiner*—Dhiru R Patel

(57) ABSTRACT

Disclosed is an electrical wiring block for an accessory. The accessory may be a switch or a receptacle. The electrical wiring block may include a base section and a wiring section positioned offset on the base section to form an overhang and an overhang seat. The base section may include a base plug and a base socket configured to fit within a base plug of an adjacent electrical wiring block. The wiring section may include wire holes, wire terminals, and wire ports positioned at an angle to the wire terminals. The wiring section may include a wiring section indent that may allow access to the wire ports on an adjacent, connected electrical wiring block. The overhang seat may cradle the overhang of an adjacent, connected electrical wiring block. The switch or receptacle may be installed in the electrical wiring block by pushing.

13 Claims, 5 Drawing Sheets

ELECTRICAL WIRING BLOCK SYSTEM

BACKGROUND

1. Field

The information disclosed relates to a configured block that may be utilized to provide electrical wiring connections for accessories, such as switches and receptacles.

2. Background Information

Building wiring may include conductors used to carry electricity and their accessories. For example, an installer may place toggle switches on a room wall, where they may be used to turn on and off lights in that room. Wall receptacles may provide two electric sockets as a duplex outlet into which computers, printers, and radios may be plugged to receive electricity. Typically, building wiring may be passed into a switch box mounted inside a building wall and connected to a toggle switch. The toggle switch itself then may be mounted to the switch box. A duplex wall receptacle similarly may be connected to the building wiring within an outlet box.

Initially installing or subsequently replacing either a light switch or a duplex wall receptacle typically requires the use of hand tools to manipulate small screws within the confines of an electrical box, such as a switch box or an outlet box. This is a difficult task, particularly for residential homeowners who occasionally replace a light switch or receptacle. In addition, it is a time consuming task for construction contractors. When multiple toggle switches or multiple wall receptacles are place next to each other in double and triple-gang electrical boxes, the task is even more difficult.

SUMMARY

Disclosed is an electrical wiring block for an accessory. The accessory may be a switch or a receptacle. The electrical wiring block may include a base section and a wiring section positioned offset on the base section to form an overhang and an overhang seat. The base section may include a base plug and a base socket configured to fit within a base plug of an adjacent electrical wiring block. The wiring section may include wire holes, wire terminals, and wire ports positioned at an angle to the wire terminals. The wiring section may include a wiring section indent that may allow access to the wire ports on an adjacent, connected electrical wiring block. The overhang seat may cradle the overhang of an adjacent, connected electrical wiring block. The switch or receptacle may be installed in the electrical wiring block by pushing.

DETAILED DESCRIPTION

The information below relates to a configured electrical wiring block that may be utilized to provide electrical wiring connections for accessories, such as switches and receptacles. Some elements may have a reference number designation and other elements may have a reference number-letter designation. In the various figures, like elements are given the same reference numbers and the letter portion of the designation is used to distinguish like elements of one electrical wiring block from another electrical wiring block.

Figure 1:
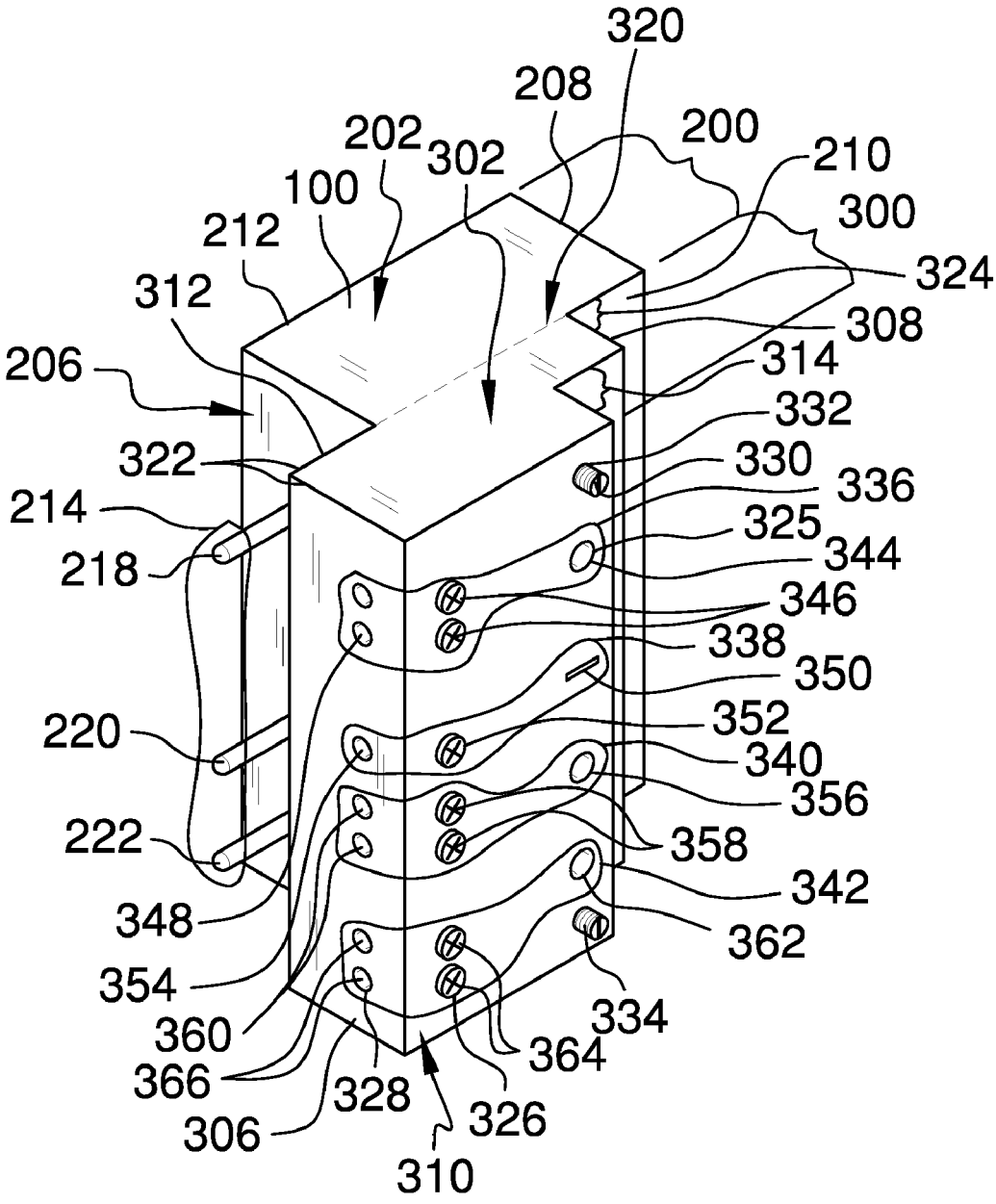
FIG. 1 is an isometric left, top view of an electrical wiring block 100.
Figure 2:
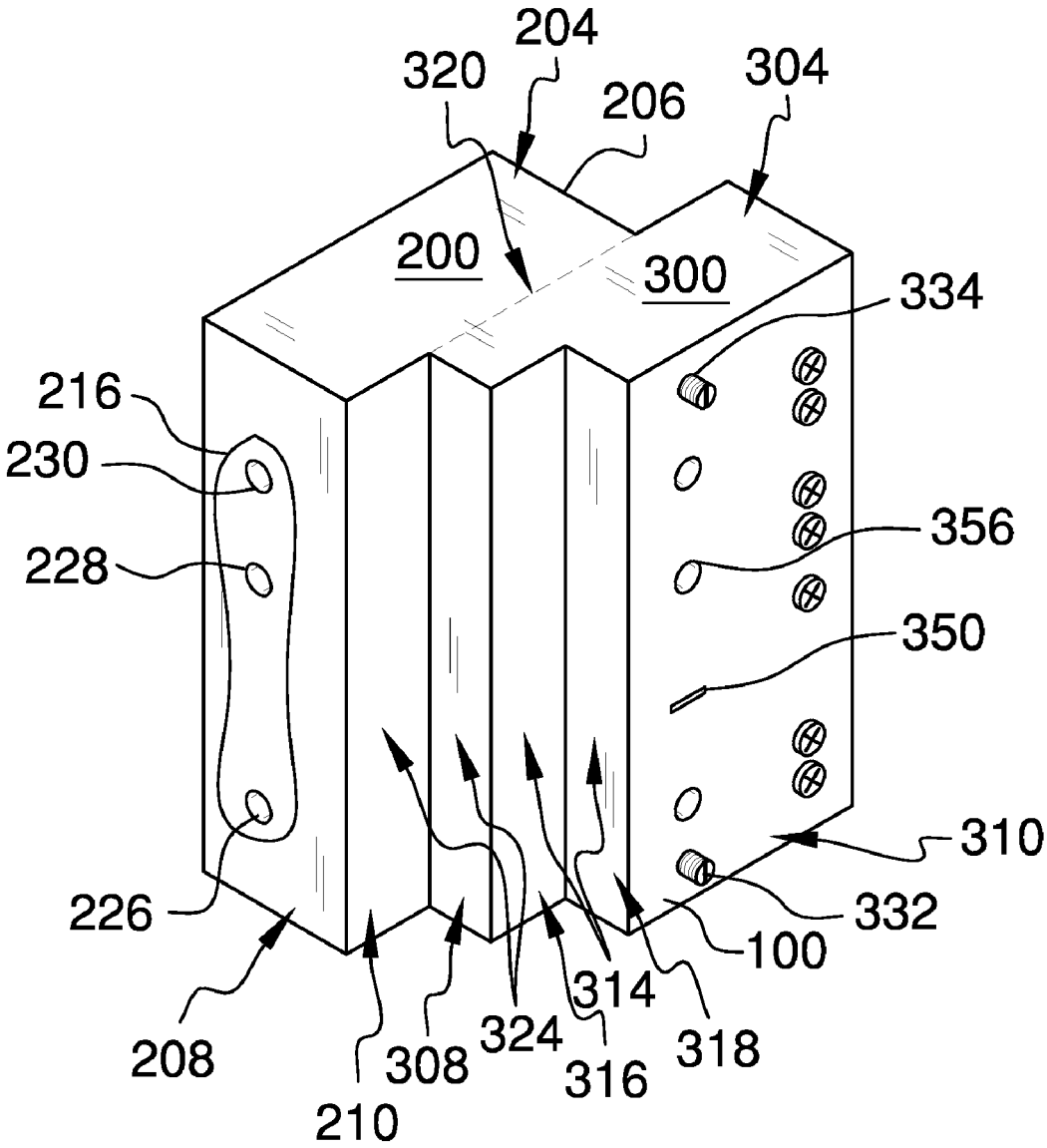
FIG. 2 is an isometric right, top view of electrical wiring block 100.

FIG. 1 is an isometric left, top view of an electrical wiring block 100. FIG. 2 is an isometric right, top view of electrical wiring block 100. Electrical wiring block 100 may include a base section 200 positioned against a wiring section 300. Wiring section 300 may be configured to receive accessories, such as a switch 500 (FIG. 5) and a receptacle 600 (FIG. 6), without a need to turn small screws. Here, switch 500 and receptacle 600 may be plugged into wiring section 300. Electrical wiring block 100 may be utilized to carry electricity from a power source into accessories, such as switch 500 (FIG. 5) and receptacle 600 (FIG. 6). Multiple electrical wiring blocks 100 may be plugged into each other in series and be fed from the same source of power. This may reduce the number of wire, jumper wires, and dangerous wire bends utilized within electrical boxes, such as double and triple-gang electrical boxes.

Base section 200 may be that part of electrical wiring block 100 configured to lead electrical wiring block 100 into an electrical box. Base section 200 may include exterior surfaces, such as a base top 202, a base bottom 204 (FIG. 2), a base left side 206, a base right side 208 (FIG. 2), a base front 210, and a base rear 212. Base rear 212 may be that portion of electrical wiring block 100 configured to contact a surface of an electrical box.

Base top 202, base bottom 204, base left side 206, base right side 208, base front 210, and base rear 212 may come together to form an outer boundary of base section 200. For example, base front 210 and base rear 212 may be connected by each of base top 202, base bottom 204, base left side 206, and base right side 208. Base top 202 and base bottom 204 additionally may be connected by base left side 206 and base right side 208.

The exterior surfaces of base section 200 may be flat, curved, or otherwise contoured. In one example, at least one exterior surface of base section 200 may be at an acute or obtuse angle to another exterior surface of base section 200. In another example, at least one exterior surface of base section 200 substantially may be at a right angle (ninety-degree angle) to another exterior surface of base section 200. In a further example, base section 200 may have a rectangular shape.

Base section 200 may include a base plug 214 (FIG. 1) and a base socket 216 (FIG. 2) positioned on a side of base section 200 that may be opposite that of base plug 214. Here, base plug 214 may be attached to and extend away from base left side 206 and base socket 216 may be attached to and extend into base right side 208. Base plug 214 may be a first part of two mating halves of a connector that may be moveable when not fastened to the other mating half. Base socket 216 may be a second part of two mating halves of a connector that may be moveable when not fastened to the other mating half. Base socket 216 of a first electrical wiring block 100 may be configured to receive base plug 214 of a second electrical wiring block 100 such that multiple electrical wiring blocks 100 may be ganged together in series.

Plugs may have a line contact, a neutral contact, and a ground contact. Although terminology may vary, a line contact (which also may be known as live, phase, hot, active, and mains) may include a conductor connected with an electrical system that has electric potential to electrical ground or electrical neutral. Neutral may refer to a conductor with continuity to an electrical system's center tap of a power company transformer of a single-phase system, or a center of a wye connection of a polyphase system. A neutral contact, along with a line contact, may complete a circuit between a power source and equipment. Ground (which also may be known as earth) may be a conductor with continuity to earth. While line power may be though of as house electrical power supply, the use of the term line (as well as neutral and ground) are not meant to limit electrical wiring block 100 to residential or other particular use.

Base plug 214 may be thought of as a male electrical connector configured to be pressed into and fit within a female electrical socket. Base plug 214 may include one or more contacts, such as a plug line contact 218, a plug ground contact 220, and a plug neutral contact 222. Each of plug line contact 218, plug ground contact 220, and plug neutral contact 222 may be slender, tapered round pegs that may include at least one of brass, tin, and nickel to assist in electrical conduction. Plug line contact 218, plug ground contact 220, and plug neutral contact 222 substantially may be parallel to each other. A distance between plug line contact 218 and plug ground contact 220 substantially may be twice a distance between plug ground contact 220 and plug neutral contact 222. Base plug 214 may have a base plug length 224 (FIG. 3) as measured from base left side 206 to a tip of one of plug line contact 218, plug ground contact 220, and plug neutral contact 222.

Base socket 216 (FIG. 2) may be thought of as a female electrical connector configured to receive and fit about male electrical plug. Base socket 216 may include one or more passages, such as a socket line passage 226, a socket ground passage 228, and a socket neutral passage 230. Each of socket line passage 226, socket ground passage 228, and socket neutral passage 230 may be openings from base right side 208 into base bottom 204 that substantially may be parallel to each other and may align with plug line contact 218, plug ground contact 220, and plug neutral contact 222, respectively. Socket line passage 226, socket ground passage 228, and socket neutral passage 230 may include at least one of brass, tin, and nickel to assist in electrical conduction. A distance between socket line passage 226 and socket ground passage 228 (see FIG. 2) substantially may be twice a distance between socket ground passage 228 and socket neutral passage 230.

Under some circumstances, there may not be a need to connect together multiple electrical wiring blocks 100. In one example plug line contact 218, plug ground contact 220, and plug neutral contact 222 may be removable from base section 200, such as by unscrewing each of plug line contact 218, plug ground contact 220, and plug neutral contact 222. In another example, base section 200 may not include base plug 214 and/or base socket 216.

Wiring section 300 may be that part of electrical wiring block 100 configured to follow base section 200 into an electrical box. Wiring section 300 may include exterior surfaces, such as a wiring section top 302, a wiring section bottom 304 (FIG. 2), a wiring section left side 306, a wiring section right side 308 (FIG. 2), a wiring section front 310, and a wiring section rear 312. Wiring section front 310 may be that portion of electrical wiring section block 100 configured to face away from a rear surface of an electrical box to receive switch 500 (FIG. 5) or receptacle 600 (FIG. 6).

Wiring section top 302, wiring section bottom 304, wiring section left side 306, wiring section right side 308, wiring section front 310, and wiring section rear 312 may come together to form an outer boundary of wiring section 300. For example, each of wiring section top 302, wiring section bottom 304, wiring section left side 306, and wiring section right side 308 may connect wiring section front 310 and wiring section rear 312. Wiring section top 302 and wiring section bottom 304 additionally may be connected by wiring section left side 306 and wiring section right side 308.

The exterior surfaces of wiring section 300 may be flat, curved, or otherwise contoured. In one example, at least one exterior surface of wiring section 300 may be at an acute or obtuse angle to another exterior surface of wiring section 300. In another example, at least one exterior surface of wiring section 300 substantially may be at a right angle (ninety-degree angle) to another exterior surface of wiring section 300. In a further example, wiring section 300 may have a rectangular shape.

Wiring section 300 may include a wiring section indent 314. Wiring section indent 314 may be a channel formed by dividing a depth distance of wiring section right side 308 into two smaller depth distances. Adjacent material may be removed from at and below wiring section front 310 and from at and below wiring section right side 308 to form wiring section indent 314 that may extend from wiring section top 302 to wiring section bottom 304. Wiring section indent 314 may be remote from wiring section rear 312 and from base front 210. Wiring section indent 314 may include a first/lower wiring section indent side 316 (FIG. 2) and a first/upper wiring section indent side 318 (FIG. 2) that may meet with first/lower wiring section indent side 316.

In one example, first wiring section indent side 316 may be position at an acute or obtuse angle to second wiring section indent side 318. In another example, first wiring section indent side 316 substantially may be parallel to wiring section front 310 and second wiring section indent side 318 substantially may be parallel to wiring section left side 306. As discussed in more detail with FIG. 4, a second wiring section indent 314B of a second electrical wiring block 100B and a portion of a first wiring section left side 306A of a first electrical wiring block 100A may form a port well 402AB (FIG. 4) to provide access to wire ports 328A (hidden in view) of first electrical wiring block 100A when multiple electrical wiring blocks 100A, 100B, 100C, 100D, etc. are connected together.

Wiring section rear 312 may be attached to base front 210 at a demarcation line 320 (FIG. 2). Demarcation line 320 may be an imaginary device or real parting line that may identify where wiring section 300 ends and base section 200 begins. Although base section 200 and wiring section 300 may be part of one molded piece, base section 200 and wiring section 300 alternatively may be separate pieces later joined together such as by bonding.

In one example, wiring section rear 312 may be positioned offset against base front 210 so that part of wiring section rear 312 may extend beyond base left side 206 to hang over base plug 214 and part of base front 210 may extend beyond wiring section right side 308. When offset from each other, wiring section 300 may include an overhang 322 and base front 210 may meet wiring section right side 308 to form an overhang seat 324.

Overhang 322 may include wiring section rear 312 and wiring section left side 306 that may meet wiring section rear 312. Overhang seat 324 may include base front 210 and wiring section right side 308 that may meet base front 210. An overhang seat 324 of a first electrical wiring block 100 may be configured to receive an overhang 322 of a second electrical wiring block 100.

Wiring section rear 312 may have an overhang distance 323 (FIG. 3) as measured from base left side 206 to wiring section left side 306. In once example, base plug length 224 substantially may equal overhang distance 323.

Wiring section 300 may include wire holes 325, wire terminals 326, wire ports 328, and wiring section threaded screws 330. Wire holes 325 may be attached to and extending into wiring section front 310. Wire terminals 326 may be attached to and projecting from wiring section front 310. Wire ports 328 may be attached to and extending into wiring section left side 306 to be positioned at an angle to wire holes 325. Wiring section threaded screws 330 may be attached to and extending away from wiring section front 310.

Wire holes 325 may be thought of as female electrical connectors configured to receive and fit about male electrical connectors. Wire holes 325 may include one or more passages, each of which may be openings into wiring section 300 that substantially may be parallel to each other. Wire holes 325 may include at least one of brass, tin, and nickel to assist in electrical conduction.

Wire terminals 326 may be thought of as contacts at which electric current may enter or leave electrical wiring block 100. Wire terminals 326 may be configured to receive wires and other connectors and may include splices solder lugs, tongue crimp terminals, ring terminals, turrets, test probes, pogo terminals, clips, screw terminals, tab terminals, quick-connect terminals, quick-disconnect terminals, and tip terminals. Wire terminals 326 may include at least one of brass, tin, and nickel to assist in electrical conduction.

Wire ports 328 may be thought of as female electrical connectors configured to receive and fit about male electrical connectors. Wire ports 328 may include one or more passages, each of which may be openings into wiring section 300 that substantially may be parallel to each other. Wire ports 328 may include at least one of brass, tin, and nickel to assist in electrical conduction.

Wiring section threaded screws 330 may be fasteners extending from wiring section 300 having a raised helical rib extending outward that may be configured to receive mounting nuts. Wiring section threaded screws 330 may include a first wiring section threaded screw 332 positioned near both wiring section top 302 and second wiring section indent side 318. Wiring section threaded screws 330 may include a second wiring section threaded screw 334 positioned near both wiring section bottom 304 and second wiring section indent side 318. In an alternate example, wiring section threaded screws 330 may be fasteners sunk in wiring section 300 to be flush with wiring section front 310 and having space around wiring section threaded screws 330 to receive a nut. In an alternate example, section threaded screws 330 may be wiring section threaded cavities. Wiring section threaded cavities may be openings within wiring section 300 having a raised helical rib extending inward that may be configured to receive mounting screws.

Wiring section 300 may include as a set, holes, terminals, and ports to accommodate the electrical needs of each line, load, ground, and neutral conductor on switch 500 (FIG. 5) and receptacle 600 (FIG. 6). Wiring section 300 may include a line junction 336 (FIG. 1), a load junction 338, a ground junction 340, and a neutral junction 342.

Figure 3:
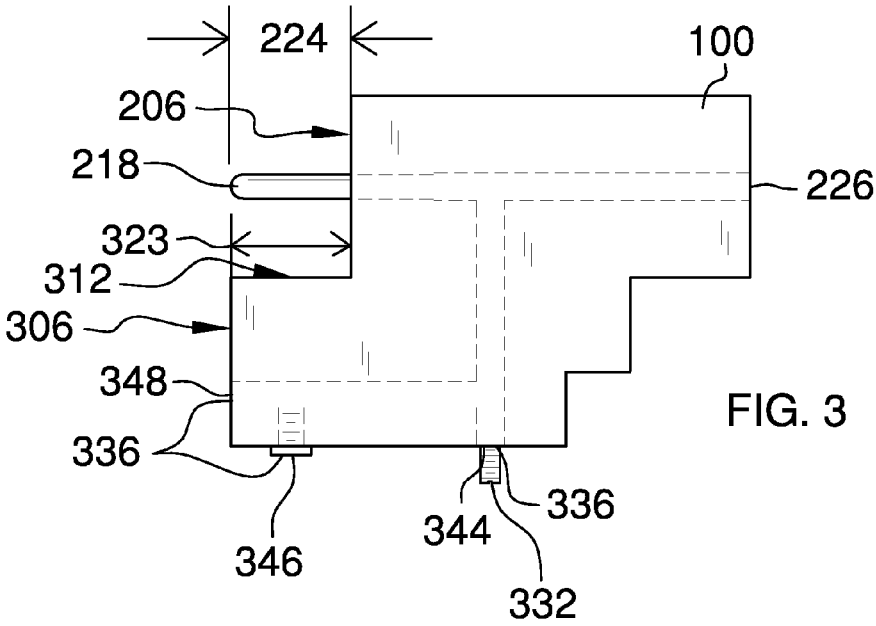
FIG. 3 is a top view of electrical wiring block 100 having an electrical schematic imposed therein.

Line junction 336 may include a line hole 344, line wire terminals 346, and line wire ports 348. FIG. 3 is a top view of electrical wiring block 100 having an electrical schematic imposed therein. Line hole 344, line wire terminals 346, line wire ports 348, plug line contact 218, and plug line passage 226 may be configured to be in electrical communication with each other. For example, an electrical current introduced into one of plug line contact 218 and socket line passage 226 may be transmitted within electrical wiring block 100 and received by each other and in line hole 344, line wire terminals 346, line wire ports 348, and plug line passage 226.

Load junction 338 (FIG. 1) may include a load slot hole 350, a load wire terminal 352, and a load wire port 354. Load slot hole 350 may be an elongated orifice having parallel sides. With load slot hole 350 being a slot and the remaining wire holes 325 and wire ports 328 being round holes, a user may be prevented from improperly connecting switch 500 (FIG. 5) and receptacle 600 (FIG. 6), for example, to electrical wiring block 100. Similar to the connection for line junction 336, each element of load junction 338 may be configured to be in electrical communication with the remaining elements of load junction 338.

Ground junction 340 may include a ground hole 356, ground wire terminals 358, and ground wire ports 360. Similar to the connection for line junction 336 in FIG. 3, each element of ground junction 340 may be configured to be in electrical communication with the remaining elements of ground junction 340 and with plug ground contact 220 and plug ground passage 228 (FIG. 2). Neutral junction 342 may include a neutral hole 362, neutral wire terminals 364, and neutral wire ports 366. Similar to the connection for line junction 336 in FIG. 3, each element of neutral junction 342 may be configured to be in electrical communication with the remaining elements of neutral junction 342 and with plug neutral contact 222 and plug neutral passage 230 (FIG. 2).

In one example, a distance between line hole 344 and load slot hole 350 substantially may be equal to a distance between load slot hole 350 and ground hole 356. In another example, line hole 344, load slot hole 350, ground hole 356, and neutral hole 362 substantially may be evenly spaced from each other.

Figure 4:
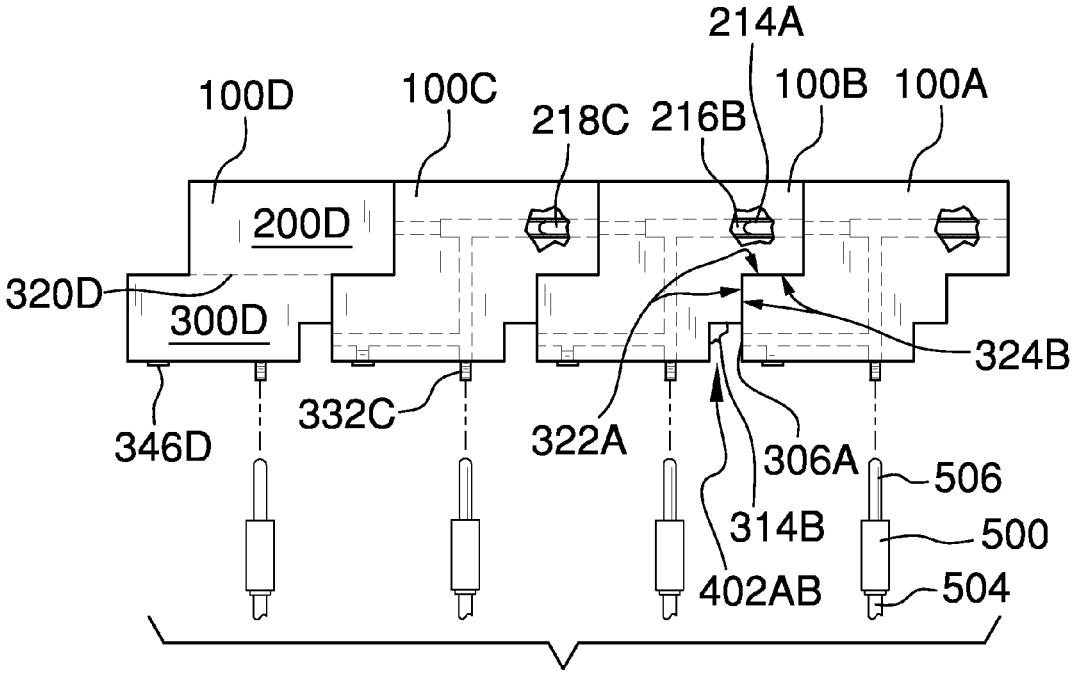
FIG. 4 is a top view of multiple electrical wiring blocks 100A-100D ganged together.

FIG. 4 is a top view of multiple electrical wiring blocks 100A-100D ganged together. Electrical wiring block 100 of FIG. 1 may be typical of electrical wiring block 100A, electrical wiring block 100B, electrical wiring block 100C, and electrical wiring block 100D of FIG. 4. In the arrangement of FIG. 4, a first base plug 214A of a first electrical wiring block 100A may be inserted into a second base socket 216B of a second electrical wiring block 100B until a first overhang 322A of first electrical wiring block 100A is cradled within a second overhang seat 324B of second electrical wiring block 100B. A mating of first overhang 322A with second overhang seat 324B may aid in aligning first electrical wiring block 100A with second electrical wiring block 100B as well as provide structural support that may relieve a need for first base plug 214A to provide a structural support between first electrical wiring block 100A and second electrical wiring block 100B. Also, a second wiring section indent 314B of second electrical wiring block 100B and a portion of wiring section left side 306 of first electrical wiring block 100A may form port well 402AB. Port well 402AB may provide access to first wire ports 328A (hidden in view) of first electrical wiring block 100A when multiple electrical wiring blocks 100A and 100B are connected together as in FIG. 4.

Figure 5:
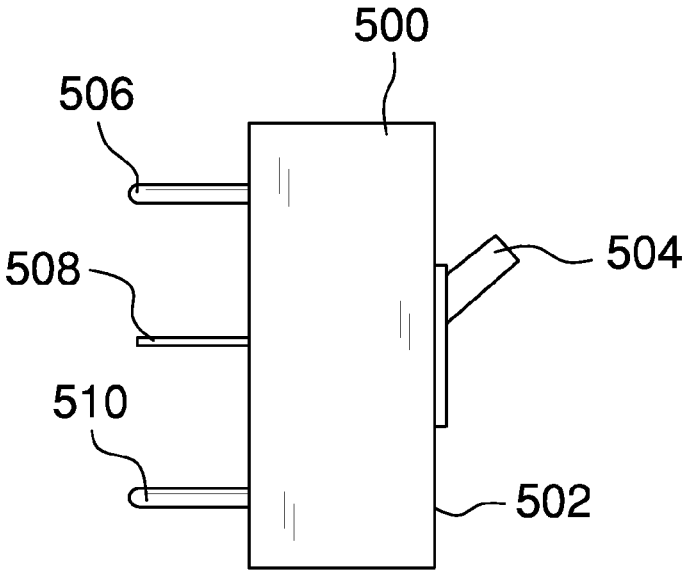
FIG. 5 is a side view of switch 500.
Figure 6:
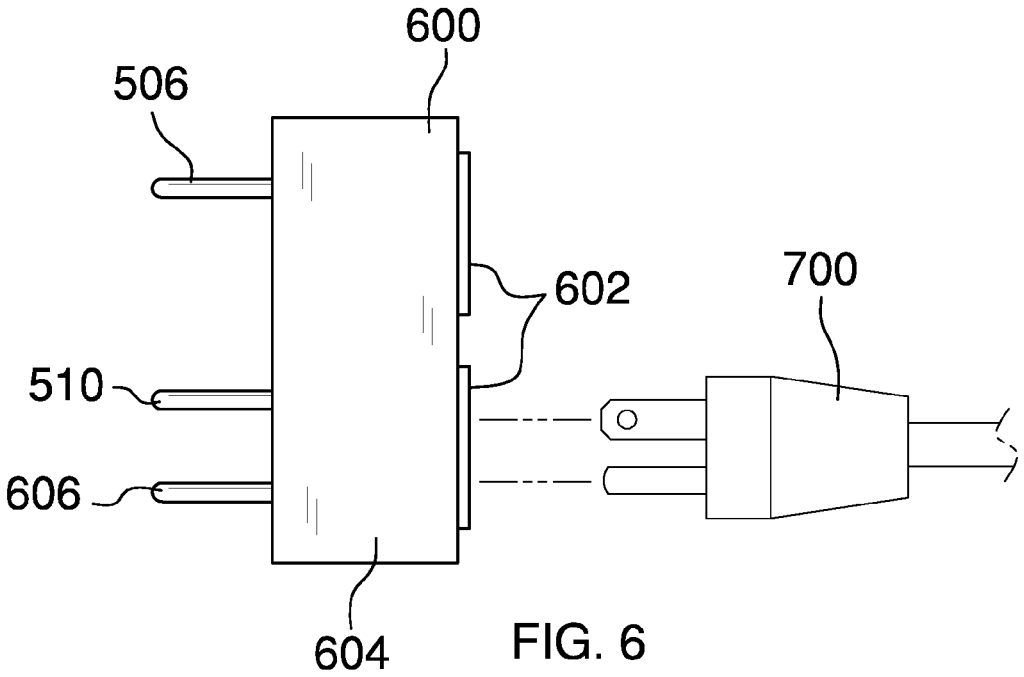
FIG. 6 is a side view of receptacle 600.

FIG. 5 is a side view of switch 500. Switch 500 may be an electronic device to at least one of make, break, and change the connections in a circuit. In one example, switch 500 may be a light switch to operate electric lights, permanently connected equipment, and electrical outlets. Although switch 500 is shown as a toggle switch in FIG. 5, switch 500 may be a different type of switch, such as push button, rocker, mercury, electronic, three-way, and four-way.

Switch 500 may include a switch housing 502, a lever 504, a line pin 506, a load prong pin 508, and a ground pin 510. Lever 504 may be attached to a first side of switch housing 502 and line pin 506, load prong pin 508, and ground pin 510 may be attached to an opposite of switch housing 502. Switch housing 502 may be a protective cover configured to contain and support switch component within switch housing 502. Lever 504 may be a rigid bar configured to pivot about a fulcrum.

Line pin 506 and ground pin 510 each may be attached to and extend away from switch housing 502. Line pin 506 and ground pin 510 each may be slender, tapered round pegs that may include at least one of brass, tin and nickel to assist in electrical conduction. Load prong pin 508 may be flat and include at least one of brass, tin, and nickel to assist in electrical conduction. Load prong pin 508 may prevent wrong plug on electrical wiring block 100.

Line pin 506, load prong pin 508, and ground pin 510 substantially may be parallel to each other and may be evenly spaced from each other. Line pin 506 may be configured to mate with line hole 344 (FIG. 1), load prong pin 508 may be configured to mate with load hole slot 350, and ground pin 510 may be configured to mate with ground hole 356.

FIG. 6 is a side view of receptacle 600. Receptacle 600 may be a female electrical connector having electric sockets 602 that may accept insertion of pins, blades, and prongs of a power plug 700 to deliver electricity to power plug 700.

In addition to electric sockets 602, receptacle 600 may include a receptacle housing 604, line pin 506, ground pin 510, and a neutral pin 606. Electric sockets 602 may be attached to a first side of receptacle housing 604 and line pin 506, ground pin 510, and a neutral pin 606 may be attached to an opposite of receptacle housing 604. Receptacle housing 604 may be a protective cover configured to contain and support receptacle component within receptacle housing 604.

Line pin 506, ground pin 510, and neutral pin 606 each may be attached to and extend away from receptacle housing 604. Line pin 506, ground pin 510, and neutral pin 606 each may be slender, tapered round pegs that may include at least one of brass, tin and nickel to assist in electrical conduction. Line pin 506, ground pin 510, and neutral pin 606 substantially may be parallel to each other. A distance between line pin 506 and ground pin 510 substantially may be twice a distance between ground pin and neutral pin 606.

Similar to line pin 506 for switch 500, line pin 506 of receptacle 600 may be configured to mate with line hole 344 (FIG. 1) and ground pin 510 may be configured to mate with ground hole 356. Neutral pin 606 may be configured to mate with neutral hole 362.

Figure 7:
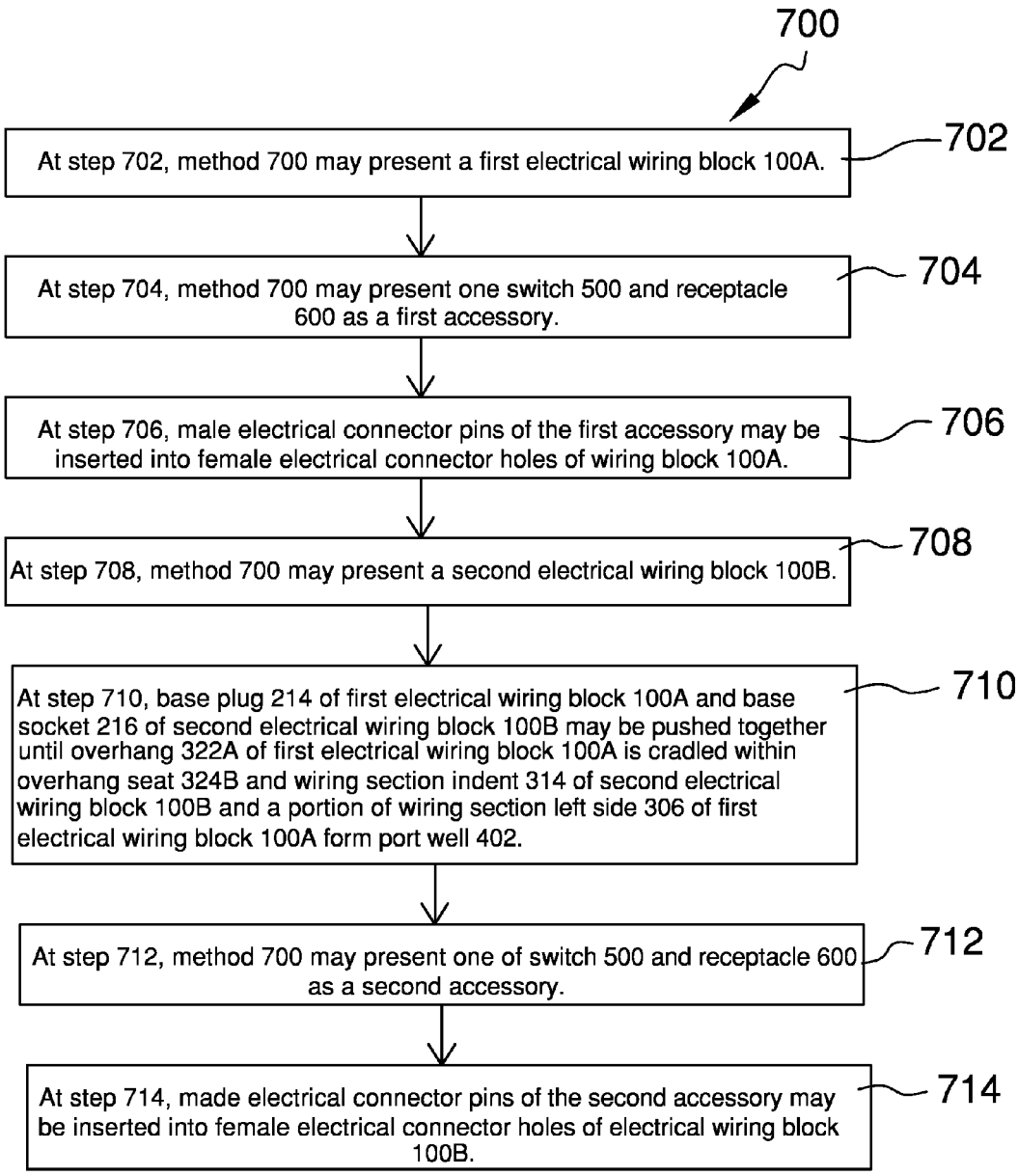
FIG. 7 is a method 700 to make an electrical wiring block 100 assembly.

FIG. 7 is a method 700 to make an electrical wiring block 100 assembly. An electrical wiring block 100 assembly may include at least one of switch 500 and receptacle 600. An electrical wiring block 100 assembly further may include two or more electrical wiring blocks 100.

At step 702, method 700 may present a first electrical wiring block 100A. At step 704, method 700 may present one of switch 500 and receptacle 600 as a first accessory. At step 706, male electrical connector pins of the first accessory may be inserted into female electrical connector holes of electrical wiring block 100A. For example, line pin 506 of switch 500 may be pushed into line hole 344 (FIG. 1), load prong pin 508 may be pushed into load hole slot 350, and ground pin 510 may be pushed into ground hole 356. Alternatively, line pin 506 of receptacle 600 may be pushed into line hole 344 (FIG. 1) and ground pin 510 may be pushed into ground hole 356. Neutral pin 606 may be pushed into neutral hole 362.

At step 708, method 700 may present a second electrical wiring block 100B. At step 710, base plug 214 of first electrical wiring block 100A and base socket 216 of second electrical wiring block 100B may be pushed together until overhang 322A of first electrical wiring block 100A is cradled within overhang seat 324B and wiring section indent 314 of second electrical wiring block 100B and a portion of wiring section left side 306 of first electrical wiring block 100A form port well 402. At step 712, method 700 may present one of switch 500 and receptacle 600 as a second accessory. At step 714, male electrical connector pins of the second accessory may be inserted into female electrical connector holes of electrical wiring block 100B.

The electrical wiring block may provide a way to install or replace either a light switch or standard duplex receptacle. Since such installation or replacement may not require the use of hand tools, either task may take much less time, or an individual may not need to handle small screws.

Both receptacles and light switches may incorporate a set of brass prongs (conductors) on a back of each device that may be pushed into place during installation of either type of device. In addition, a back half of each electrical box in which the receptacles or switches may be installed may include a mounting electrical wiring block (in essence a small plastic box with a set of mating cylindrical contacts). One side of the electrical wiring block may include three ports for connection of the hot, neutral, and ground wires of the electrical cable (110-volt circuitry) within walls. For ease of installation, the mounting clips or lugs for each electrical wiring block may be adjustable, allowing a cover plate for the box to fit snugly against the surrounding wall after installation of a switch or receptacle.

As an added benefit, the mounting electrical wiring block may be furnished in another model. In this case, the side of the electrical wiring block opposite the ports may include three pins that may be pushed in turn into the ports of another electrical wiring block in the same box. This model may be utilized with both double and triple-gang boxes when two or three devices are to be installed in the box. In a daisy chain of electrical wiring blocks, while the electrical wiring blocks are physically plugged into each other in a chain, any devices that receive power from the chain may be electrically connected in series. The improvements to both the switches and the receptacles may be integrated into the standard production processes for switches and receptacles at various manufacturers' plants.

Two or more electrical wiring blocks may be ganged together to permit installation of groups of switches and receptacles. Ganged together electrical wiring blocks may be fed from the same source of power. Connections may be made through the base plug in pins and ports as electrical wiring blocks are pushed together. Wire nuts and jumper wires may be eliminated when multiple electrical wiring blocks are connected together. This may eliminate crowding in boxes and eliminate dangerous bends in wires. Wire connections may be made inside wall mounted electrical boxes for easy access and electrical wiring block replacement may be necessary.

The electrical wiring block may be a modular base electrical wiring device for switches and receptacles that may make electrical wiring faster, neater, and safer. Mounted in wall boxes to organize wiring in a clean appearance, light switches and receptacles may be plugged into a modular base. The depth may be adjusted to align cover plates. The bases may be ganged together for multiple devices. The electrical wiring block may include plastic and metal. The electrical wiring block may make home wiring installations faster, neater for a more professional appearance, and safer and may save time and money. The electrical wiring block may be replaced by a homeowner. There may be different configurations for different types of switches, such as three-way, four-way, and the like. When switches and receptacles break or otherwise need removal and/or replacing, this may be done without turning off power. The electrical wiring block, switches, and/or receptacles may be adjusted in and out, making switch plates fit correctly. Electrical wiring blocks easily may be ganged (snapped together) for multiple switches and receptacles.

The electrical wiring block may fulfill a need for a much easier way to install or replace either a duplex receptacle or a light switch. Appealing features of the electrical wiring block system may be its convenience, ease of installation, saving of time, and reasonable price. Contractors and do-it-yourselfers may find the electrical wiring block wiring quite helpful in wiring switches and receptacles in that they may no longer need to handle small screws during installation of either device. In each case, an individual simply may push the accessory (switch or receptacle) into the mounting electrical wiring block.

The information disclosed herein is provided merely to illustrate principles and should not be construed as limiting the scope of the subject matter of the terms of the claims. The male electrical connector terms pin, plug, prong, contact and the like and the female electrical connector terms hole, slot, passage, and the like used in this patent are meant to assist visually in distinguishing similar functioning elements. The written specification and figures are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. A first electrical wiring block for an accessory, where the accessory includes at least one of a switch and a receptacle, the first electrical wiring block comprising:

a first base section having a first base plug and a first base socket positioned on a side of the first base section that is opposite that of the first base plug, where the first base socket is configured to fit around a second base plug of a second electrical wiring block having an identical configuration to the first electrical wiring block, where the first base plug includes a first plug line contact, and where the first base socket includes a first socket line passage; and a first wiring section positioned offset on the first base section to form a first overhang with the first base section and to form a first overhang seat with the first base section, where the first overhang is on a side of the first wiring section that is opposite that of the first overhang seat, where the first wiring section includes first wire holes, first wire terminals, and first wire ports, where the first overhang seat is configured to cradle a second overhang of the second electrical wiring block when the second base plug is fully inserted into the first base socket, where the first wiring section includes a first line junction, where the first line junction includes a first line hole, a first line wire terminal, and a first line wire port, where the first line hole, the first line wire terminal, and the first line wire port are configured to be in electrical communication with each other such that an electrical current introduced into one of the first plug line contact and the first socket line passage is received in each of the first line hole, the first line wire terminal, and the first line wire port, where the first wiring section further includes a first wiring section indent to allow access to second wire ports on the second electrical wiring block when the second base plug is fully inserted into the first base socket, where the first wiring section indent consists of a first channel having a first lower wiring section indent side and a first upper wiring section indent side, where the first lower wiring section indent side and the first upper wiring section indent side are straight and meet each other at an angle, and where the first base section and the first wiring section are part of a one molded piece.

2. The first electrical wiring block of claim 1, where the lower wiring section indent side and the upper wiring section indent side of the first wiring section meet each other at a ninety-degree angle.

3. The first electrical wiring block of claim 1, where each first wiring port is positioned at an angle to a respective first wire terminal of the first wire terminals.

4. The first electrical wiring block of claim 1, where the first base plug includes the first plug line contact, a first plug ground contact, and a first plug neutral contact, where a distance between the first plug line contact and the first plug ground contact substantially is twice a distance between the first plug ground contact and the first plug neutral contact, and where the first base socket includes a first socket line contact, a first socket ground contact, and a first socket neutral contact, where a distance between the first socket line contact and the first socket ground contact substantially is twice a distance between the first socket ground contact and the first socket neutral contact.

5. The first electrical wiring block of claim 4, where at least one of the first plug line contact, the first plug ground contact, and the first plug neutral contact is removeably secured to the first base section.

6. The first electrical wiring block of claim 4, where the first base section includes a first base left side and the first wiring section includes a first wiring section left side, where the first base plug includes a first base plug length as measured from the first base left side to a tip of one of the first plug line contact, the first plug ground contact, and the first plug neutral contact, where the first wiring section rear has a first overhang distance as measured from the first base left side to the first wiring section left side, and where the first base plug length substantially equals the first overhang distance.

7. The first electrical wiring block of claim 6, where the first wiring section rear extends beyond the first base left side of the first base section to hang over the first base plug.

8. The first electrical wiring block of claim 1, where the first wiring section has a rectangular shape.

9. An electrical wiring block system for accessories, the electrical wiring block system comprising:

a first accessory, where the accessory include at least one of a switch and a receptacle; and a first electrical wiring block having a first base section and a first wiring section, where the first base section includes a first base front and a first base rear connected by each of a first base top, a first base bottom, a first base left side, and a first base right side, where the first base top and the first base bottom are connected by the first base left side and the first base right side, where the first base section includes a first base plug connected to the first base left side and includes a first base socket connected to the first base right side, where the first wiring section includes a first wiring section front and a first wiring section rear connected by each of a first wiring section top, a first wiring section bottom, a first wiring section left side, and a first wiring section right side, where the first wiring section top and the first wiring section bottom are connected by the first wiring section left side and the first wiring section right side, where first adjacent material is removed from at and below the first wiring section front and at and below the first wiring section right side to form a first wiring section indent extending from the first wiring section top to the first wiring section bottom, where the first wiring section indent is remote from the first wiring section rear and includes a first lower wiring section indent side that meets a first upper wiring section indent side, where the first wiring section rear is positioned offset against the first base front so that part of the first wiring section rear extends beyond the first base left side and part of the first base front extends beyond the first wiring section right side, where the first wiring section includes a first overhang that includes the first wiring section rear and the first wiring section left side, where the first wiring section includes a first overhang seat that includes the first wiring section right side and the first base front, where the first overhang seat of the first electrical wiring block is configured to receive a second overhang of a second electrical wiring block, where the first wiring section includes first wire holes that are attached to and extending into the first wiring section front, where the first wiring section includes first wire terminals that are attached to and projecting from the first wiring section front, and where the first wiring section includes first wire ports that are attached to and extending into the first wiring section left side to be positioned at an angle to the first wire holes, where the first wiring section includes a first line junction, a load junction, a first ground junction, and a first neutral junction, where the first line junction includes a first line hole, a first line wire terminal, and a first line wire port, where the first line hole, the first line wire terminal, and the first line wire port are configured to be in electrical communication with each other such that an electrical current introduced into one of the first plug line contact and the first socket line passage is received in each of the first line hole, the first line wire terminal, and the first line wire port, where the first load junction includes a first load slot hole, a first load wire terminal, and a first load wire port, where the first load slot hole is an elongated orifice having parallel sides, where the first ground junction includes a first ground hole, a first ground wire terminal, and a first ground wire port, and where the first neutral junction includes a first neutral hole, a first neutral wire terminal, and a first neutral wire port.

10. The electrical wiring block system of claim 9, where the switch includes a line pin that is configured to mate with the first line hole, where the switch includes a ground pin that is configured to mate with the first ground hole, where the receptacle includes a line pin that is configured to mate with the first line hole, where the receptacle includes a ground pin that is configured to mate with the first ground hole, and where the receptacle includes a neutral pin that is configured to mate with the first neutral hole.

11. The electrical wiring block system of claim 10, further comprising:

the second electrical wiring block, where the second electrical wiring block includes a second wiring section and a second base section, where the second base section is configured to mate with the first electrical wiring block base section, where the second block base section includes a second base front and a second base rear connected by each of a second base top, a second base bottom, a second base left side, and a second base right side, where the second base top and the second base bottom are connected by the second base left side and the second base right side, where the second base section includes a second base plug connected to the second base left side and includes a second base socket connected to the second base right side, where the second electrical wiring block wiring section includes a second wiring section front and a second wiring section rear connected by each of a second wiring section top, a second wiring section bottom, a second wiring section left side, and a second wiring section right side, where the second wiring section top and the second wiring section bottom are connected by the second wiring section left side and the second wiring section right side, where second adjacent material is removed from at and below the second wiring section front and at and below the second wiring section right side to form a second wiring section indent extending from the second wiring section top to the second wiring section bottom, where the second wiring section indent is remote from the second wiring section rear and includes a second lower wiring section indent side that meets a second upper wiring section indent side, where the second wiring section rear is positioned offset against the second base front so that part of the second wiring section rear extends beyond the second base left side and part of the second base front extends beyond the second wiring section right side, where the second wiring section includes a second overhang that includes the second wiring section rear and the second wiring section left side, and where the second wiring section includes a second overhang seat that includes the second wiring section right side and the second base front, where the second overhang seat of the second first electrical wiring block is configured to receive the first overhang of the first electrical wiring block, where the second wiring section includes second wire holes that are attached to and extending into the second wiring section front, where the second wiring section includes second wire terminals that are attached to and projecting from the second wiring section front, and where the second wiring section includes second wire ports that are attached to and extending into the second wiring section left side to be positioned at an angle to the second wire holes, where the second wiring section includes a second line junction, a second load junction, a second ground junction, and a second neutral junction, where the second line junction includes a second line hole, a second line wire terminal, and a second line wire port, where the second line hole, the second line wire terminal, and the second line wire port are configured to be in electrical communication with each other such that an electrical current introduced into the second base plug is received in each of the second line hole, the second line wire terminal, and the second line wire port, where the second load junction includes a second load slot hole, a second load wire terminal, and a second load wire port, where the second load slot hole is an elongated orifice having parallel sides, where the second ground junction includes a second ground hole, a second ground wire terminal, and a second ground wire port, and where the second neutral junction includes a second neutral hole, a second neutral wire terminal, and a second neutral wire port.

12. A method to make an electrical wiring block assembly, the method comprising:

presenting a first electrical wiring block having a first base section and a first wiring section positioned on the first base section, where the first base section includes a first base plug and a first base socket, where the first base socket is configured to fit around a second base plug of a second electrical wiring block having an identical configuration to the first electrical wiring block, where the first wiring section is positioned offset on the first base section to form a first overhang with the first base section and a first overhang seat with the first base section, where the first wiring section includes first wire holes, first wire terminals, and first wire ports, and where the first overhang seat is configured to cradle a second overhang of the second electrical wiring block when a second base plug of the second electrical wiring block is fully inserted into the first base socket;

presenting a first accessory having male electrical connector pins, where the accessory includes at least one of a switch and a receptacle;

inserting the male electrical connector pins of the first accessory into the first wire holes of the first wiring block of the first electrical wiring block;

presenting the second electrical wiring block having a second base section and the second wiring section positioned on the second base section, where the second base section includes a second base plug and a second base socket, where the second base socket is configured to fit around the first base plug of the first electrical wiring block, where the second wiring section is positioned offset on the second base section to form a second overhang with the second base section and a second overhang seat with the second base section, where the second wiring section includes second wire holes, second wire terminals, and second wire ports, and where the second overhang seat is configured to cradle the first overhang of the first electrical wiring block; and pushing together the first base plug of the first electrical wiring block and the second base socket of the second electrical wiring block until the first overhang of the first electrical wiring block is cradled within the second overhang seat of the second electrical wiring block and the second wiring section indent of the second electrical wiring block and a portion of the first wiring section left side of the first electrical wiring block form a first port well.

13. The method of claim 12, where pushing together the first base plug of the first electrical wiring block and the second base socket of the second electrical wiring block includes pushing together the first base plug of the first electrical wiring block and the second base socket of the second electrical wiring block until a second wiring section indent of the second electrical wiring block and a portion of the first wiring section left side of the first electrical wiring block form a second port well.

* * * * *